US009215904B2

(12) United States Patent
Sackett

(10) Patent No.: US 9,215,904 B2
(45) **Date of Patent: *Dec. 22, 2015**

(54) HELMET HAVING MAGNETICALLY COUPLED CHEEK PADS

(71) Applicant: Bell Sports, Inc., Scotts Valley, CA (US)

(72) Inventor: Christopher David Sackett, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 17 days.

This patent is subject to a terminal disclaimer.

(21) Appl. No.: 14/047,875

(22) Filed: Oct. 7, 2013

(65) Prior Publication Data

US 2014/0033403 A1 Feb. 6, 2014

Related U.S. Application Data

(63) Continuation of application No. 12/985,784, filed on Jan. 6, 2011, now Pat. No. 8,549,671.

(51) Int. Cl.

| | |
|---|---|
| ***A42B 3/06*** | (2006.01) |
| ***A42B 3/12*** | (2006.01) |
| ***A42B 3/32*** | (2006.01) |

(52) U.S. Cl.

CPC ..... *A42B 3/127* (2013.01); *A42B 3/328* (2013.01)

(58) Field of Classification Search

CPC ..... A42B 3/127; A42B 3/328

USPC ..... 2/410, 6.2, 411, 414, 417, 422, 424, 2/425, 421; 24/303

See application file for complete search history.

(56) References Cited

U.S. PATENT DOCUMENTS

| | | | | |
|---|---|---|---|---|
| 1,569,181 | A * | 1/1926 | Hartman | 2/414 |
| 2,731,663 | A * | 1/1956 | Murray | 16/422 |
| 3,372,443 | A * | 3/1968 | Daddona, Jr. | 24/303 |
| 4,903,349 | A * | 2/1990 | Arai | 2/421 |
| 4,916,759 | A * | 4/1990 | Arai | 2/414 |
| 6,170,084 | B1 * | 1/2001 | Gordon et al. | 2/12 |
| 6,185,753 | B1 * | 2/2001 | Arai | 2/414 |
| 6,256,797 | B1 * | 7/2001 | Nemoto et al. | 2/414 |
| 6,479,560 | B2 * | 11/2002 | Freitag et al. | 521/130 |
| 7,246,384 | B2 * | 7/2007 | Bentz | 2/421 |
| 8,256,033 | B2 * | 9/2012 | Arai | 2/414 |
| 2004/0168246 | A1 * | 9/2004 | Phillips | 2/411 |
| 2007/0271688 | A1 * | 11/2007 | Ando | 2/410 |
| 2009/0038054 | A1 * | 2/2009 | Ikeda | 2/414 |
| 2010/0095437 | A1 * | 4/2010 | Ikeda | 2/414 |
| 2010/0275347 | A1 * | 11/2010 | Baldackin et al. | 2/411 |

* cited by examiner

*Primary Examiner* — Anna Kinsaul

(74) *Attorney, Agent, or Firm* — Booth Udall Fuller, PLC

(57) ABSTRACT

In accordance with the teachings of the present invention, a helmet having magnetic coupling is provided. In a particular embodiment, the helmet includes at least one protective layer configured to cover at least a portion of a user's head and a pad coupled to a back plate, a back plate coupled to a protective layer, a back plate comprising a magnet.

14 Claims, 4 Drawing Sheets

HELMET HAVING MAGNETICALLY COUPLED CHEEK PADS

TECHNICAL FIELD OF THE INVENTION

The present invention relates generally to protective headgear and, more particularly, to a helmet having magnetically coupled pads.

BACKGROUND

Protective headgear, such as helmets, are often used in activities, such as bicycling, skateboarding, motorcycling, race car driving, rock climbing, snowboarding, and skiing, that are associated with an increased risk of head injury. Typically, such protective headgear is designed to maintain its structural integrity and stay secured to the head of a wearer, while protecting the wearer from a trauma to the head. In many types of protective headgear, such as motorcycle helmets, interior pads are often coupled via plastic or metal snaps. Unfortunately, this coupling can easily break, experience coupling problems due to manufacturing tolerances or reduce access in emergency situations.

SUMMARY

In accordance with the teachings of the present invention, a helmet having magnetically coupled pads is provided. In a particular embodiment, the helmet includes at least one protective layer configured to cover at least a portion of a user's head. The protective layer includes a padding layer to increase comfort and protection. The pad is coupled to a back plate that contains one or more magnets. The protective layer is coupled to a back plate and the back plate contains one or more magnets. The back plate on the protective layer and the back plate on the pad is configured to couple via the one or more magnets contained in each back plate.

Technical advantages of one or more embodiments of the present invention may include providing for improved coupling of pads to a helmet to allow ease of insertion and removal.

Another technical advantage of particular embodiments of the present invention includes providing a helmet with a more comfortable fit against a user's head. The ease of insertion and removal of the pads in particular embodiments allow for a more personalized fit for each individual. For example, pads of a different thickness may be quickly exchanged to provide a more comfortable fit for different headshapes of different users.

Another technical advantage of particular embodiments of the present invention includes providing a helmet that is more easily removable during emergency situations. Due to the magnetic coupling between the pad and the protective layer, emergency personnel may slide the pad out of the helmet of the injured user and then remove the entire helmet without substantially moving the injured user. Particular embodiments may include an emergency release strap to facilitate fast removal.

It will be understood that the various embodiments of the present invention may include some, all, or none of the enumerated technical advantages. In addition, other technical advantages of the present invention may be readily apparent to one skilled in the art from the figures, description and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
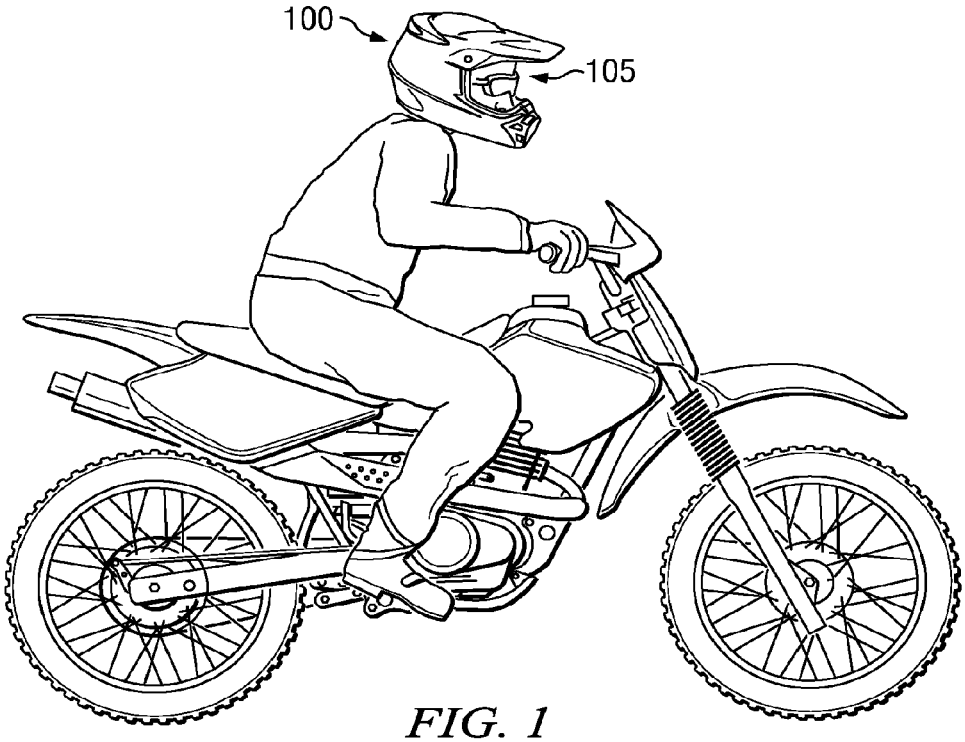
FIG. 1 illustrates an environment in which a helmet in accordance with a particular embodiment of the present invention may be used.

FIG. 1 illustrates an environment in which a helmet in accordance with a particular embodiment of the present invention may be used. Example helmet 100 is operable to protect a user's (a wearer's) head 105. Example helmet 100 may offer coverage to any one or more parts of the user's head, including, for example, the top, back, and sides of the user's head, to protect the user from head traumas. Although helmet 100 is a motorcycle helmet, helmets made according to the present invention may include any type of protective headgear, including, for example and without limitation, a bicycling, skateboarding, motorcycling, race car driving, rock climbing, snowboarding, and skiing helmet.

Figure 2:
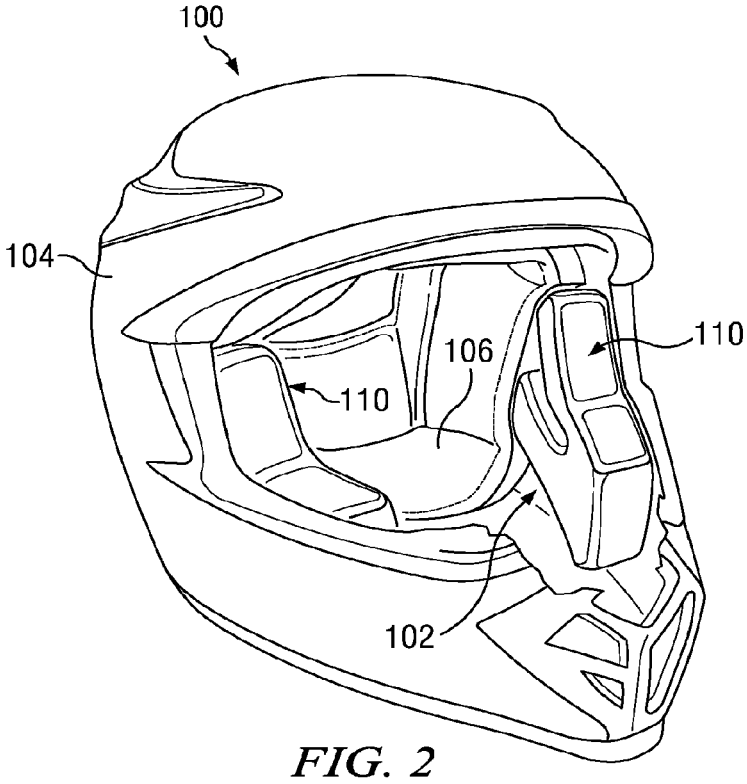
FIG. 2 is a diagram illustrating a view (with portions broken away) of a helmet with cheek pads installed according to one embodiment of the present invention.

As illustrated in the example embodiment in FIG. 2, helmet 100 comprises an outer protective layer. Outer protective layer (or shell) 104 includes any layer of material or combination of materials operable to provide an additional layer of protection around an inner protective layer 102 (not illustrated), such as, for example and without limitation, polycarbonate plastic, carbon fiber/Kevlar/fiberglass tri-weave, or fiberglass. Inner protective layer 102 includes any layer of material or combination of materials operable to protect a user's head from an impact, such as, for example, expanded polystyrene (EPS). Cheek pads 110 may be installed in the interior of inner protective layer 102 on either side of the helmet. In some embodiments, inner protective layer 102 may have additional pads 106 such as liners, for example, to provide more comfort and protection to the user. Cheek pads 110 include any layer of material or combination of materials operable to protect a user's head from an impact, for example, material such as foam encased in nylon. In some embodiments, cheek pads 110 are provided to offer a more secure fit for the user (wearer). Check pads of different size can be placed in the helmet at the point of sale to ensure the best fit for user's (wearer's) head.

Figure 3:
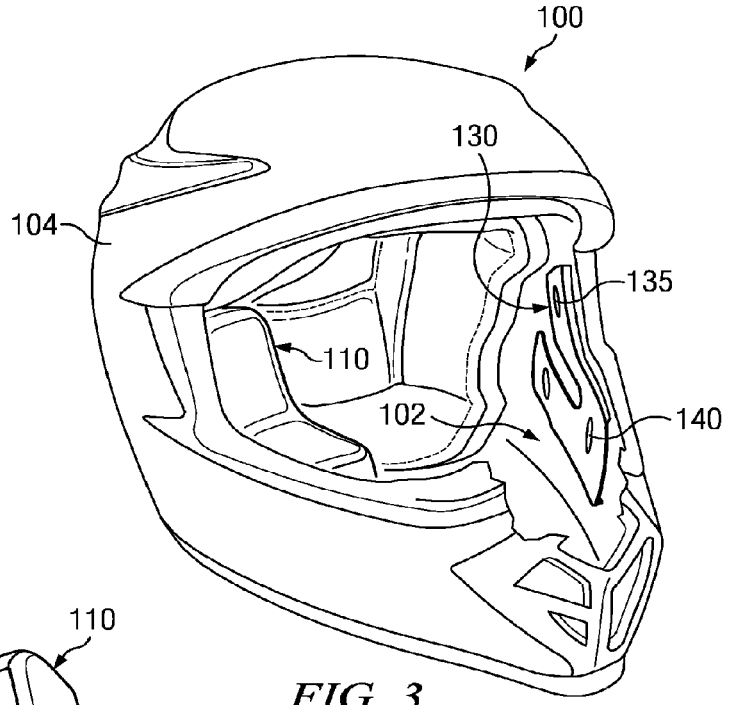
FIG. 3 is a diagram illustrating a view (with portions broken away) of a helmet with a cheek pad removed according to one embodiment of the present invention.

FIG. 3 is a diagram illustrating a view of the helmet of FIG. 1. As illustrated in the example embodiment in FIG. 3, a chin bar back plate 130 is coupled to the inner protective layer 102. The back plate 130 may be adhered to the inner protective layer 102 via glue or any other adhesive materials. In other embodiments, the back plate may be in-molded with the inner protective layer 102 such that the risers are part of the inner protective layer. The chin bar back plate 130 may comprise HDPE 7260 or other similar material operable to provide the structure for coupling and supporting pad connections. The chin bar back plate 130 comprises one or more risers 140 configured to couple with an associated cheek pad 110. The risers are configured to comprise a magnet 145 and to provide a recess 135 to facilitate coupling of the associated cheek pad 110. FIG. 3 shows three risers, however, in other embodiments the number of risers and their location may vary. The magnets 145 may comprise rare earth materials or any other magnetic material suitable to lock the cheek pad in position.

Figure 4A:
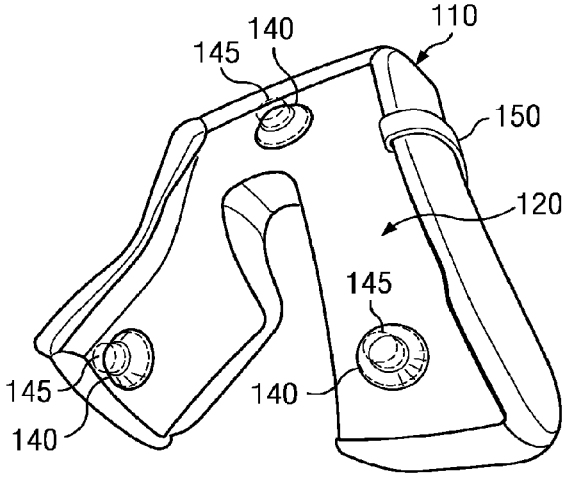
FIG. 4A is a diagram illustrating a view of a cheek pad according to one embodiment of the present invention.
Figure 4B:
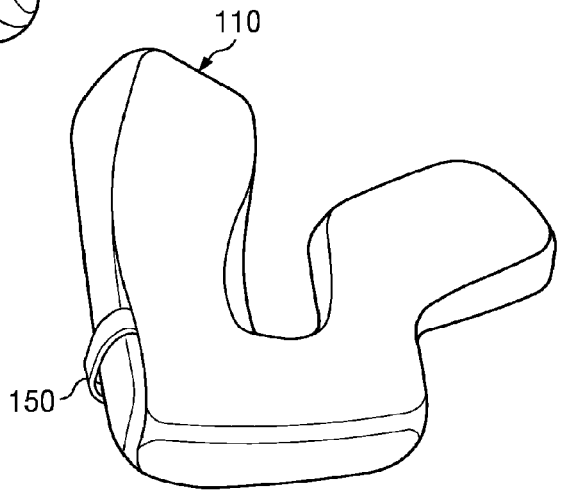
FIG. 4B is a diagram illustrating an alternate view of the cheek pad presented in 4A according to one embodiment of the present invention.

FIGS. 4A and B are diagrams illustrating a front and back view of a cheek pad 110. As is illustrated, the cheek pad 110 includes a cheek pad back plate 120.

The back plate 120 includes a number of risers 140 which are configured to couple with recesses 135 of back plate 130. As with back plate 130, each riser 140 includes a magnet 145.

As illustrated in the example embodiment in FIG. 4A, the cheek pads 110 include any layer of material or combination of materials operable to protect a user's head from an impact, for example, material such as foam encased in nylon. The cheek pad back plate 120 may be adhered to the checkpad 110 via an adhesive material such as glue, for example. However, other methods of adhesion may be used. In some embodiments, the cheek pad back plate connection may be further reinforced by sewing the edges to the padding. The cheek pad back plate 120 may include any layer of material or combination of materials operable to provide a solid layer to form the risers 140 which are configured to couple with recesses 135 of back plate 130.

Also illustrated in FIGS. 4A and B, is an emergency release strap 150 attached to the base of the cheek pad. The emergency release strap aids the user or other personnel to grab the cheek pad 110 for quick removal. Once the check pads are removed from the helmet, the helmet can easily be removed from the user's head without substantially moving the user. This is helpful in emergency situations.

Figure 5:
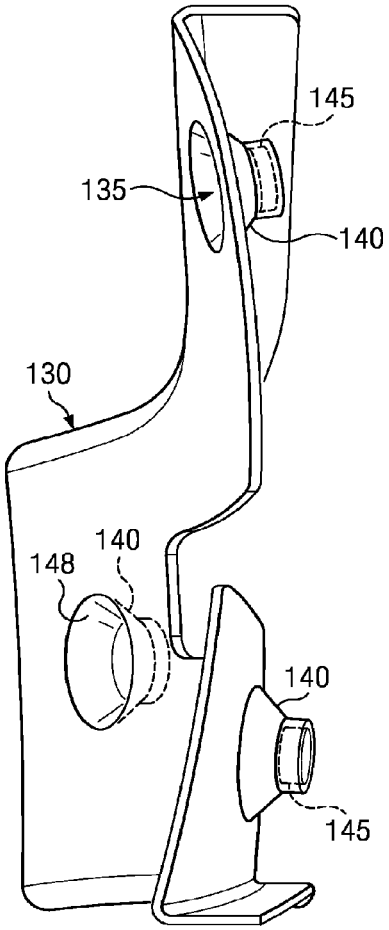
FIG. 5 is a diagram illustrating a view of the back plate according to one embodiment of the present invention.

FIG. 5 is a diagram illustrating a view of a back plate with riser 140 containing recess 135 and magnets 145. As noted above, the risers are configured to couple with each riser 140 of back plate 120. In this embodiment, the risers 140 are configured to be inserted in recess 135. The magnets 145 embedded in each riser 140 provide a locking mechanism to ensure the pads remain in position. Each recess 135 includes a ramped side 148. In the illustrated embodiment, sides are at a forty-five degree angle; however, any suitable angle may be used. As is illustrated in FIG. 4A, riser 140 also has ramped sides that correspond with the ramped sides or recesses 134. These ramped sides allow for ease of insertion of risers 140 into recesses 135 (they are self-centering). The ramped sides also enable pads 110 to be removed by a downward force applied to emergency release straps 150.

Figure 6:
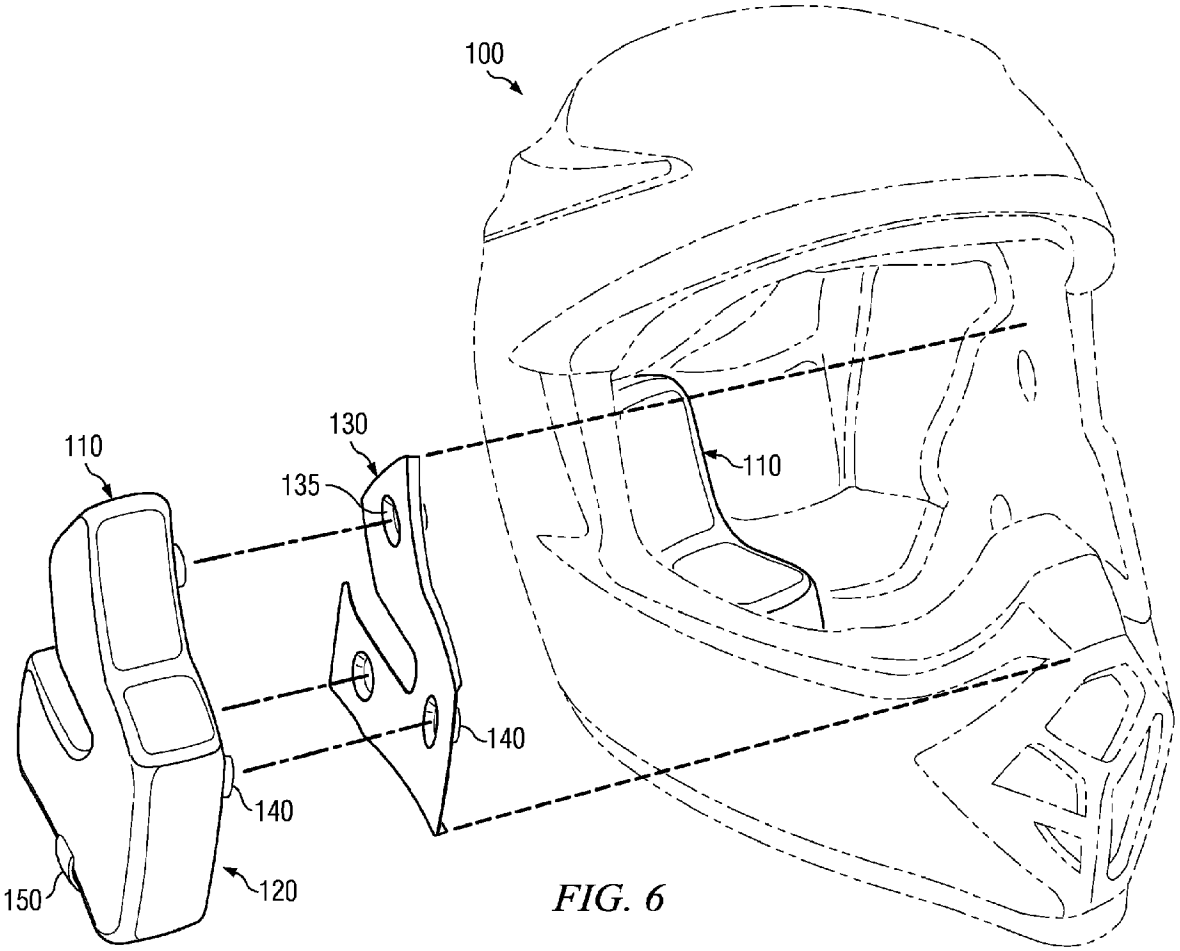
FIG. 6 is a diagram illustrating an exploded view of a cheek pad and a chin bar back plate connecting to the helmet of FIG. 1 according to one embodiment of the present invention.

FIG. 6 is a diagram illustrating an exploded view of the helmet of FIG. 1 according to one embodiment of the present invention. As illustrated in FIG. 6, the cheek pad 110 has a back plate that includes risers 140 that couple with the recesses 135 in the chin bar backing plate 130. The chin bar backing plate 130 couples with the EPS in the helmet 100. Although a particular configuration of backplanes, risers and recesses is shown, other embodiments may comprise different shapes and the risers and recesses may be reversed between the back plates 120 and 130.

Figure 7:
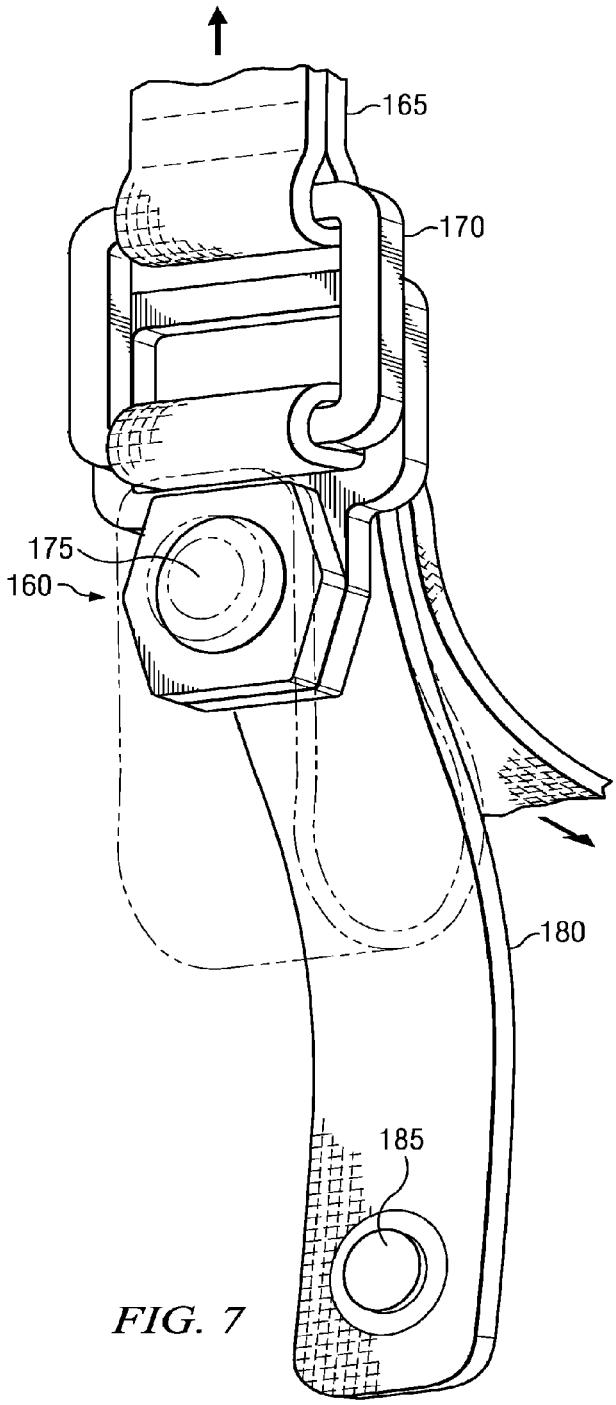
FIG. 7 is a diagram illustrating a view of a chin strap magnetic keeper according to one embodiment of the present invention.

FIG. 7 is a diagram illustrating a magnetic strap keeper 160. Magnetic strap keeper 160 comprises two chin straps attached to each side of the helmet 100. In this embodiment, chin strap 165 is coupled to a D-ring closure 170. Other embodiments may use a buckle or other suitable device for connecting two straps. b-ring closure 170 comprises a magnet 175. In this embodiment, a chin strap 180 comprises a magnet 185 configured to couple to magnet 175. Chin strap 180 is woven through D-ring closure 170 to couple it to chin strap 165 to secure helmet 100 to the user's head. Chin strap 180 should be pulled completely through D-ring closure 170 to ensure a tight fit to the user's head. Magnet 185 may be coupled to magnet 175 to secure the lose end of chin strap 180 to the D-ring closure 170. Magnets 175 and 185 may comprise any material suitable to lock the chin strap 180 in place. Chin strap 160 includes any layer of material or combination of materials, for example nylon, operable to provide a secure connection and withstand multiple insertions. In other embodiments, the magnets may be located in different position on chin straps 165 and 185 and D-ring closure 170.

As described above, helmets are used in a variety of activities, such as, for example, bicycling, skateboarding, motorcycling, race car driving, rock climbing, snowboarding, and skiing. Helmets offer substantially full coverage to the top, back, and sides of the user's head to better protect the user from head traumas. As a disadvantageous by-product, the helmet's substantially full coverage of the user's head reduces access to the user in cases of emergency. In addition, historical couplings of the cheek pads to the helmet have not allowed for easily interchangeable cheek pads due to variations in manufacturing tolerances.

To alleviate current issues with cheek pads that snap in place, the present invention comprises magnetic check pads. The magnetic check pads facilitate easy connection for users to adjust the fit of the helmet by changing the cheek pads. Another advantage of magnetic cheek pad is easy removal while the helmet is on the users head. This is especially useful during emergency situations where the cheek pad removal allows for easy removal of the helmet without disturbing the injured person.

Although the present invention has been described with several embodiments, various changes and modifications may be suggested to one skilled in the art. It is intended that the present invention encompass such changes and modifications as fall within the scope of the appended claims.

What is claimed is:

1. A helmet, comprising:

protective layers comprising a protective shell and an inner protective layer, the protective layers configured to cover at least a portion of a user's head;

a cheek pad configured to be releasably coupled within the protective layers, the cheek pad comprising:

an emergency release strap, a padding layer, and a pad back plate comprising one or more first risers, wherein at least one of the one or more first risers comprises both an embedded magnet and ramped sides; and a helmet back plate coupled to the inner protective layer, the helmet back plate comprising one or more second risers comprising ramped sides corresponding to the ramped sides of the at least one of the one or more first risers, the one or more second risers configured to be magnetically coupled to, and self-centered with, the first risers of the pad back plate to couple the cheek pad to the protective layers;

wherein the ramped sides of the one or more second risers of the helmet back plate are designed to decouple the pad back plate from the helmet back plate when the pad back plate is pulled in a direction toward a bottom helmet opening at an angle steeper than a ramp angle of the ramped sides of the one or more first risers; and wherein the cheek pad is designed to be removed from the protective layers of the helmet while the protective layers cover at least the portion of the user's head.

2. The helmet of claim 1, wherein the emergency release strap is directly connected to the cheek pad and is accessible at the base of the helmet when the cheek pad is installed in the helmet.

3. The helmet of claim 1, wherein the cheek pad comprises foam encased in nylon; and the pad back plate comprises high density polyethylene (HDPE).

4. The helmet of claim 1, wherein the one or more second risers of the pad back plate comprise a recessed area.

5. The helmet of claim 1, wherein the helmet back plate comprises high density polyethylene (HDPE).

6. The helmet of claim 4, wherein the one or more second risers also comprises an embedded magnet.

7. The helmet of claim 6, wherein the ramped sides of the one or more first risers and the ramped sides of the one or more second risers are angled at approximately 45 degrees.

8. The helmet of claim 1, further comprising a chin strap that secures the helmet in place on the users head;

the chin strap comprises a first strap and a second strap;

the chin strap comprises a closure for coupling the first and the second straps;

wherein the first strap comprises a first magnet coupled to an end of the first strap; and wherein the closure comprises a second magnet configured to couple to the first magnet to secure the end of the first strap.

9. A helmet, comprising:

a protective shell configured to cover at least a portion of a user's head;

a cheek pad configured to be disposed within the protective shell, the cheek pad comprising:

an emergency release strap directly connected to the cheek pad that is accessible at a base of the helmet when the cheek pad is disposed within the protective shell, a padding layer, and a pad back plate comprising a first riser with ramped sides; and a helmet back plate coupled to the protective shell, the helmet back plate comprising a second riser with ramped sides configured to be magnetically coupled, and self centered, to the first riser in the cheek pad, wherein the first riser, the second riser, or both comprise at least one embedded magnet;

wherein the ramped sides of the first riser and second riser are designed to decouple the pad back plate from the helmet back plate when the pad back plate is pulled in a direction toward a bottom helmet opening at an angle steeper than a ramp angle of the ramped sides of the first riser or the second riser; and wherein the cheek pad is designed to be removed from the protective shell of the helmet while the protective shell covers at least the portion of the user's head.

10. The helmet of claim 9, wherein:

the second riser comprises ramped sides corresponding to the ramped sides of the first riser.

11. The helmet of claim 9, wherein the first or second riser comprises a recessed area.

12. The helmet of claim 9, wherein the helmet back plate comprises high density polyethylene (HDPE).

13. The helmet of claim 10, wherein the ramped sides of the first riser and the ramped sides of the second riser are angled at approximately 45 degrees.

14. The helmet of claim 9, wherein:

the cheek pad comprises foam encased in nylon; and the pad back plate comprises high density polyethylene (HDPE).

* * * * *